United States Patent [19]

Pai et al.

[11] 4,297,425

[45] Oct. 27, 1981

[54] IMAGING MEMBER

[75] Inventors: Damodar M. Pai, Fairport; John M. Pochan; Darlyn F. Pochan, both of Ontario, all of N.Y.

[73] Assignee: Xerox Corporation, Stamford, Conn.

[21] Appl. No.: 163,256

[22] Filed: Jun. 26, 1980

Related U.S. Application Data

[63] Continuation-in-part of Ser. No. 78,264, Sep. 24, 1979, abandoned.

[51] Int. Cl.[3] ..... G03G 5/04; G03G 5/14

[52] U.S. Cl. ..... 430/58; 430/59

[58] Field of Search ..... 430/58, 59

[56] References Cited

U.S. PATENT DOCUMENTS 4,078,925 3/1978 Horgan ..... 430/59

4,081,274 3/1978 Horgan ..... 430/58

OTHER PUBLICATIONS

Research Disclosure, "Multi-active Photoconductive Element" May 1975, 13312, pp. 38–43.

*Primary Examiner*—Mary F. Downey

*Attorney, Agent, or Firm*—Peter H. Kondo; James P. O'Sullivan; John E. Beck

[57] ABSTRACT

An imaging member comprising a hole generation layer and a contiguous hole transport layer, said hole transport layer comprising a transparent electrically inactive polycarbonate resinous material having a residual amount of a halogen containing organic solvent therein and dispersed therein from about 25 to about 75 percent by weight based on said transport layer composition of a diamine, said charge transport layer being substantially nonabsorbing in the spectral region at which the hole generation layer generates and injects photogenerated holes, but being capable of supporting the injection of photogenerated holes from said photoconductive material and transporting said hole through said charge transport layer, said charge transport layer also containing a stabilizing proportion of a di or triaryl methane compound of the general formula:

wherein $R_1$ and $R_2$ are independently selected from the group consisting of a $C_1$–$C_8$ alkyl, aryl, alkaryl and aralkyl, where said aryl is a phenyl group or a condensed ring group, where the alkyl group of said alkaryl and aralkyl is a $C_1$–$C_4$ group, $R_3$ is independently selected from the group consisting of hydrogen and $CH_3$; and $R_4$ is the same as $R_1$ and $R_2$ or a disubstituted aminophenyl group wherein the substituents are independently selected from the group consisting of a $C_1$–$C_8$ alkyl, aryl, alkaryl and aralkyl as defined supra.

5 Claims, 1 Drawing Figure

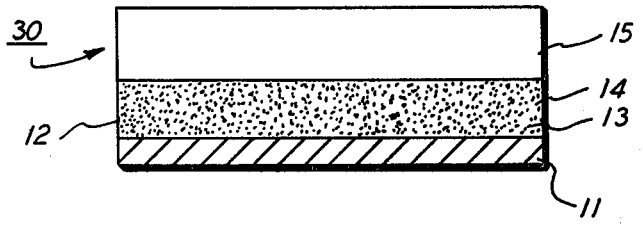
30
15
14
13
12
11

IMAGING MEMBER

This application is a continuation-in-part application of copending application Ser. No. 078,264, filed Sept. 24, 1979 now abandoned.

BACKGROUND OF THE INVENTION

This invention relates in general to xerography and more specifically to a novel photosensitive device.

In recent years, interest has been shown in flexible electrophotographic plates for use in high speed office copying machines. Some of these plates are multilayered devices comprising, a conductive substrate layer, an adhesive-blocking interface layer, a charge generation layer and a charge transport layer. The charge transport layer comprises an organic charge transport molecule dissolved in a polymeric matrix material. This layer is substantially nonabsorbing in the spectral region of intended use, i.e. visible light, but is "active" in that it allows (1) injection of photogenerated holes from the charge generation layer and (2) efficient transport of these charges to the surface of the transport layer to discharge a surface charge thereon.

One class of hole transport molecules, N,N'-diphenyl-N,N'-bis(alkylphenyl)-[1,1'-biphenyl]-4,4'-diamines, has been extensively studied as solutions or dispersions in polycarbonate polymers. The conductivity of this class of compounds in polycrbonate polymers has been found to increase under certain circumstances. When photoreceptor devices employing this class of compounds have a residual amount of a halogen-containing alkane solvent in the transport layer and they are subjected to ultraviolet radiation, a condition known as "cycle down" progressively develops as the device is cycled in the xerographic process. "Cycle down" refers to the progressive increase in conductivity of the transport layer and in a relatively short period of time the charge acceptance of the device deteriorates. Also, special precautions have to be taken with regard to the handling of the devices employing these compounds. They cannot be stored or left exposed to ambient room light for any length of time because fluorescent lamps employed in most buildings contain a UV component. This UV radiation causes devices left exposed to the room light to undergo gradual deterioration resulting in an increase in the conductivity of the transport layer.

OBJECTS OF THE INVENTION

It is therefore an object of this invention to provide a novel photosensitive device less susceptible to the deleterious effects of ultraviolet radiation degradation in the transport layer thereof.

It is a further object of this invention to provide an electrophotographic device free of "cycle down" problems caused by ultraviolet light induced increased conductivity.

PRIOR ART STATEMENT

Chemical stabilization of the physical properties of polymers has been well pursued and a host of additives are available which stabilize various polymers against ultraviolet induced discoloration or ultraviolet induced mechanical failures. As far as is known, however, no study has been done to date on the chemical stabilization of electronic properties. By electronic stabilization is meant the eliminating or minimizing of ultraviolet radiation-induced traps or ultraviolet radiation-induced dark decay and the like. To be useful as an electronic stabilizer in a cyclic duplicating machine, the additive, in addition to preventing ultraviolet degradation, has to meet another stringent requirement. The additive should not introduce traps of its own under cyclic conditions, since even a small number of traps result in the cumulative trapping phenomenon generally referred to as "cycle up". The trap could be an isolated electronic state of the additive or it could result from the additive changing the character of the dispersion of the host molecule in the binder matrix. As indicated, no prior art appears to have dealt precisely with the problem outlined above.

SUMMARY OF THE INVENTION

The foregoing objects and others are accomplished in accordance with this invention by providing a photosensitive member comprising a generator layer and an improved transport layer. The transport layer comprises a solution or dispersion of a diamine of the class defined below, in a polycarbonate resin which also contains a residual amount of a halogen-containing organic solvent and a stabilizing proportion of a diaryl or triaryl methane compound of the class defined below. By a residual amount is meant from about 0.01 to about 1.0 weight percent of the transport layer. Usually subjecting the transport layer to a temperature of about 80° C. for about 2 hours will reduce the halogen-containing solvent to about 0.1 weight percent.

It has been found that the addition to the transport layer of a diaryl or triaryl methane compound significantly reduces or eliminates photoreactions leading to the deleterious effects of ultraviolet radiation known as "cycle down". The use of this class of additives has no apparent deleterious effects of its own on the chemical or electrical properties of the hole transport layer. This is indeed unexpected because this class of compounds, i.e. the diaryl or triaryl methane compounds are known in and of themselves as effective charge transport compounds when dissolved in a polycarbonate. However, these compounds when used as the charge transport molecule, are photooxidatively unstable. As photoreceptor devices employing this class of compounds are subjected to ultraviolet radiation, a condition known as "cycle up" progressively develops as the device is cycled in a xerographic machine. "Cycle up" refers to the bulk trapping of holes in the transport layer and in a relatively short period of time, efficient discharge of the charged surface of the photoreceptor is lost.

Therefore, it is indeed unexpected that a compound which, when used alone as a charge transport material, is susceptible to the deleterious effects of UV light, would effectively inhibit the deleterious effects of UV light in a different compound.

In general, the advantages of the invention will become apparent upon consideration of the following disclosure of the invention, especially when taken in conjunction with the accompanying drawing wherein:

BRIEF DESCRIPTION OF THE DRAWING

The FIGURE is a schematic illustration of one of the members of the instant invention which comprise a photoreceptor having a charge generation layer overcoated with a charge transport layer.

DETAILED DESCRIPTION OF THE DRAWING AND INVENTION

Referring to the FIGURE, reference character 30 designates an imaging member which comprises a supporting substrate 11 having a charge generator layer 12 thereon. Substrate 11 is preferably comprised of any suitable conductive material. Typical conductors comprise aluminum, steel, nickel, brass or the like. The substrate may be rigid or flexible and of any convenient thickness. Typical substrates include flexible belts of sleeves, sheets, webs, plates, cylinders and drums. The substrate or support may also comprise a composite structure such as a thin conductive coating contained on a paper base; a plastic coated with a thin conductive layer such as aluminum, nickel or copper iodide; or glass coated with a thin conductive coating of chromium or tin oxide.

In addition, if desired, an electrically insulating substrate may be used. In this case, an electric charge, equivalent to a conductive layer, may be placed upon the insulating member by double corona charging techniques well known or disclosed in the art. Other modifications using an insulating substrate or no substrate at all include placing the imaging member on a conductive backing member or plate and charging the surface while in contact with said backing member. Subsequent to imaging, the imaging member may then be stripped from the conductive backing.

Generator layer 12 contains photoconductive particles dispersed randomly without orientation in binder 14.

Binder material 14 may comprise any electrically insulating resin such as those disclosed in Middleton et al U.S. Pat. No. 3,121,006, the entire contents of which are hereby incorporated by reference. Specific examples are polystyrene, acrylic and methacrylic ester polymers, polyvinylchlorides, etc. When using an electrically inactive or insulating resin, it is essential that there be particle to particle contact between the photoconductive particles. This necessitates that the photoconductive material be present in an amount of at least about 10% by volume of the binder layer with no limit on the maximum amount of photoconductor in the binder layer. If the matrix or binder comprises an active material, e.g., polyvinyl carbazole, the photoconductive material need only comprise about 1% or less by volume of the binder layer with no limitation on the maximum amount of photoconductor in the binder layer. The thickness of binder layer 12 is not critical. Layer thicknesses from about 0.05 to 40.0 microns have been found to be satisfactory.

The photoconductive particles 13 may be any material capable of photogenerating holes and injecting photogenerated holes into the contiguous charge transport layer 15. Any suitable inorganic or organic photoconductor and mixtures thereof may be employed. Inorganic materials include inorganic crystalline photoconductive compounds and inorganic photoconductive glasses. Typical inorganic compounds include cadmium sulfoselenide, cadmium selenide, cadmium sulfide and mixtures thereof. Typical inorganic photoconductive glasses include amorphous selenium and selenium alloys such as selenium-tellurium, selenium-tellurium-arsenic and selenium-arsenic and mixtures thereof. Selenium may also be used in a crystalline form known as trigonal selenium.

Typical organic photoconductive materials which may be used as charge generators include phthalocyanine pigment such as the X-form of metal free phthalocyanine described in U.S. Pat. No. 3,357,989 to Byrne et al; metal phthalocyanines such as copper phthalocyanine; quinacridones available from duPont under the tradename Monastral Red, Monastral Violet and Monastral Red Y; substituted 2,4-diamino-triazines disclosed by Weinberger in U.S. Pat. No. 3,445;227; triphenodioxazines disclosed by Weinberger in U.S. Pat. No. 3,442,781; polynuclear aromatic quinones available from Allied Chemical Corporation under the tradename Indo Double Scarlet, Indofast Violet Lake B, Indofast Brilliant Scarlet and Indofast Orange. The photoconductive particles may be present in the generator layer in from 0.5% to about 95% by volume depending on the charger of the binder material.

It is to be understood that the generator layer need not be dispersed photoconductive particles in a resin binder but can be a homogeneous layer, such as, amorphous selenium, selenium alloys e.g. selenium-tellurium-arsenic alloys and, in fact, any other charge generating photoconductive material which can withstand a minimum flexing stress required in a flexible photoreceptor.

Active layer 15 comprises a transparent electrically inactive polycarbonate resinous material having dispersed therein from about 25 to 75% by weight of the composition of one or more of the diamines within the scope of the following structural formula:

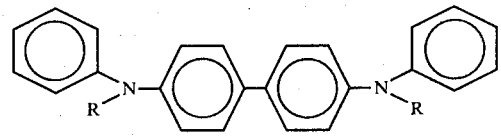

wherein R is

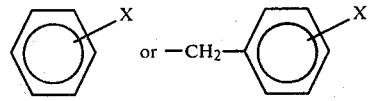

and wherein X is independently selected from the group consisting of an alkyl group having from 1 to about 4 carbon atoms (e.g. methyl, ethyl, propyl, butyl, etc.) and chlorine in the ortho, meta or para position.

In general, the thickness of active layer 15 would be from about 5 to 100 microns, but thicknesses outside this range can also be used.

The preferred polycarbonate resins for the transport layer have a molecular weight from about 20,000 to about 120,000, more preferably from about 50,000 to about 120,000.

Materials most preferred as the electrically inactive resinous material are poly(4,4'-isopropylidene-diphenylene carbonate) having molecular weights of from about 25,000 to about 40,000, available as Lexan® 145, from about 40,000 to about 45,000, available as Lexan® 141, both from the General Electric Company; and from about 50,000 to about 120,000 available as Makrolon®, from Farbenfabricken Bayer AG; and from about 20,000 to about 50,000 available as Merlon®, from Mobay Chemical Company.

Active layer 15, as described above, is substantially nonabsorbing to light in the wavelength region employed to generate holes in the photoconductive layer. This preferred range for xerographic utility is from about 4,000 to about 8,000 angstrom units. In addition, the photoconductor should be responsive to all wavelengths from 4,000 to 8,000 angstrom units if panchromatic responses are required. All photoconductor-active material combinations of the instant invention result in the injection and subsequent transport of holes across the physical interface between the photoconductor and the active material.

In order to effectively dissolve the charge transport diamine compound in the polycarbonate matrix, a suitable mutual solvent system must be employed. Methylene chloride, i.e. $CH_2Cl_2$, is effective for this purpose, although other solvents such as chloroform and 1,2-dichloroethane can be employed. Non-halogen-containing organic solvents such as tetrahydrofuran are found to be poor solvents for the high molecular weight polycarbonate.

Dispersed or dissolved in the transport layer in order to greatly minimize or eliminate the deleterious effects of ultraviolet radiation is a stabilizing proportion of one or more of the di or triphenylmethanes within the scope of the following structural formula:

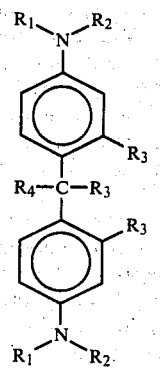

wherein $R_1$ and $R_2$ are independently selected from the group consisting of a $C_1$–$C_8$ alkyl, aryl, alkaryl and aralkyl, where said aryl is a phenyl group or a condensed ring group, where the alkyl group of said alkaryl and aralkyl is a $C_1$–$C_4$ group, $R_3$ is independently selected from the group consisting of hydrogen and $CH_3$; and $R_4$ is the same as $R_1$ and $R_2$ or a disubstituted aminophenyl group wherein the substituents are independently selected from the group consisting of a $C_1$–$C_8$ alkyl, aryl, alkaryl and aralkyl as defined supra.

Examples of compounds of this class are as follows: bis(4,N,N'-diethylamino-2-methylphenyl) phenyl methane; 1-bis-(4-dimethylaminophenyl)-1-phenyl ethane; and bis-[4-bis(phenylmethyl) amino-2-chlorophenyl] phenyl methane.

This compound may be employed in any amount which will inhibit or greatly minimize the deleterious effects of UV light on the charge transport diamine compound. Generally, it is preferred that the inhibiting compound be present in a weight ratio of from 0.0005:1 to 0.1:1.

The following examples further specifically define the present invention with respect to preparing the photosensitive members. The percentages are by weight unless otherwise indicated. The examples are intended to illustrate various comparisons and preferred embodiments of the instant invention.

EXAMPLE I

A generator layer is prepared as follows: 2.4 grams of poly(N-vinylcarbazole) is dissolved in 42 mls of a 1:1 mixture of tetrahydrofuran and toluene. To this is added 2.4 grams of chemically precipitated trigonal selenium and the mixture is then ball milled for about 72 hours in a 4 ounce bottle employing 300 grams of ⅛ inch diameter stainless steel shot. An approximately 2 micron thick layer is applied from a coating of this slurry onto a substrate of aluminized Mylar which had been previously coated with a thin adhesive film, such as, duPont 49000 ® polyester. This layer is heated at 100° C. for 18 hours in vacuum.

An approximately 25 micron thick transport layer is formed on top of the generator layer as follows:

1 gram of Makrolon ® polycarbonate and 1 gram of N,N'-diphenyl-N,N'-bis(3-methylphenyl)-[1,1'-biphenyl]-4,4'-diamine are dissolved in 10 mls of methylene chloride. A layer of 25 microns thick is overcoated onto the generator layer and heated at 80° C. in vacuum for 72 hours so as to reduce the amount of residual methylene chloride to a trace, i.e. less than 0.01 weight percent in the transport layer.

The xerographic testing of this device, as well as the devices described in subsequent examples, is carried out as follows: the layered device is negatively charged to a potential of about 1200 volts and the dark decay is monitored for 5 seconds. The device is then exposed to a 2 microsecond flash of 4330 Angstrom units wavelength and about 15 Ergs/cm$^2$ intensity. The device of this example is completely discharged by the light source, indicating that it is a xerographically operable device.

To examine the ultraviolet light stability of the device, it is exposed to an intense long wave UV source for 2 minutes, total photons 6 X $10^{16}$/cm$^2$, and retested xerographically as above. The dark decay of the device is virtually the same as the rate of decay of the device before exposure to UV light. This shows that the performance of the device is substantially unaffected by ultraviolet light.

EXAMPLE II

This device is fabricated of the same materials and in the same manner as Example I except that the device is heated at 80° C. in vacuum for only 2 hours, instead of 72 hours, with the result that about 0.1 weight percent methylene chloride remains in the transport layer. The device is xerographically tested before and after subjecting the device to ultraviolet light as in Example I. As a result of the UV exposure, the dark decay increased significantly and could not be tolerated in a practical device.

EXAMPLE III

This device is fabricated as in Example II except that the solvent employed to coat the transport layer is tetrahydrofuran instead of methylene chloride. One gram of Makrolon ® polycarbonate and 1 gram of N,N'-diphenyl-N,N'-bis(3-methylphenyl)-[1,1'-biphenyl]-4,4'-diamine are dissolved in 10 mls of tetrahydrofuran. The polycarbonate is only partially soluble in the tetrahydrofuran and difficulty was experienced in filtering the undissolved fraction from the system. The undissolved fraction must be removed otherwise efficient charge transport is sacrificed. After removal and deposition of the transport layer on the generator layer, the device is heated at 80° C. for about 2 hours. This leaves a residual of about 0.1 percent by weight tetrahydrofuran in the transport layer.

The device is xerographically tested before and after the same degree of UV exposure as above. No increase in dark decay is observed as a result of the UV energy. This indicates that no increase in dark decay or degradation of the device is caused by the presence of a residual of tetrahydrofuran and the influence of ultraviolet radiation.

EXAMPLE IV

A device is prepared having the generator layer of Example I. A transport layer is formed on top of this generator layer as follows: a solution of 1 gram of Makrolon® polycarbonate and 1 gram of bis(4,N,N'-diethylamino-2-methylphenyl) phenyl methane in 10 mls of methylene chloride. A layer of approximately 25 microns is deposited on the surface of the generator layer and heating the device at 80° C. for about 2 hours in vacuum.

When xerographically tested before and after subjecting it to the same degree of UV exposure as in Example I, no increase in dark decay is observed. However, the degradation of the transport layer appears as a tremendous increase in residuals when xerographically tested after exposure to UV radiation. The residual is the potential measured after the negatively charged device is exposed to the 4330 Angstrom units wavelength flash source. The residual potential occurs from charge trapping in the transport layer.

EXAMPLE V

This device is the same as that in Example IV except that tetrahydrofuran is the solvent employed to coat the transport layer. Thus, the transport layer is coated from a solution of 1 gram of Makrolon® polycarbonate and 1 gram of bis(4-N,N'-diethylamino-2-methylphenyl) phenyl methane in 10 mls of tetrahydrofuran. Undissolved polycarbonate is filtered from the solution. After removal and deposition of the transport layer on the generator layer the device is heated at 80° C. for 2 hours in vaccum. The transport layer is approximately 25 microns thick.

When xerographically tested before and after subjecting the device to UV exposure, a tremendous increase in residual potential is observed.

The conclusions from the results of Examples I–V are as follows: when the diamine molecule identified in Example I is dissolved in a polycarbonate which contains a significant residual amount of methylene chloride solvent and this system is exposed to UV radiation the degradation appears as an increase in conductivity and when the trisubstituted methane molecule identified in Example IV is dissolved in polycarbonate and exposed to UV radiation, the degradation appears as charge carrier trapping, resulting in an increase in residual potential.

EXAMPLE VI

The generator layer of Example I is prepared. A transport layer is prepared from a solution of 1 gram of Makrolon® polycarbonate, 0.995 gram of N,N'-diphenyl-N,N'-bis(3-methylphenyl)-[1,1'-biphenyl]-4,4'-diamine and 0.005 gram of bis(4'-N,N'-diethylamino-2-methylphenyl) phenyl methane in 10 mls of methylene chloride. A layer of this combination is deposited onto the generator layer so that after removal of the methylene chloride solvent an approximately 25 micron layer remains. The device is heated at 80° C. for about 2 hours in vacuum. This reduces the methylene chloride content to about 0.1 weight percent.

When xerographically tested before and after subjecting it to UV exposure, there was no increase in dark decay. Also, there was no increase in the residual potentials. The degradation of the diamine containing layer is prevented by the addition of the substituted methane molecule.

EXAMPLE VII

This device is similar to the device of Example VI except that the transport layer composition is varied slightly. The transport layer is coated from a solution of 1 gram of Makrolon® polycarbonate, 0.95 gram of the diamine and 0.05 gram of the substituted methane compound in 10 mls of methylene chloride. After deposition of the transport layer, the device is heated at 80° C. for 2 hours in vaccum.

When xerographically tested before and after being subjected to the UV exposure, no change in dark decay is observed. Further, no increase in residual potential is observed. The photodischarge of the device containing the diamine and the substituted methane compound in polycarbonate is the same as that of the device containing no substituted methane, i.e. Example II. These results prove that the UV degradation of the diamine in polycarbonate layers containing residual methylene chloride is prevented by the presence of the substituted methane compound. The presence of the methane compound does not adversely impact the charge transport characteristics of the transport layer.

What is claimed is:

1. In an imaging member comprising a hole generation layer and a contiguous hole transport layer, said generation layer comprising a photoconductive material exhibiting the capability of photogeneration of holes and injection of said holes, said hole transport layer comprising a transparent electrically inactive polycarbonate resinous material having a residual amount within the range of from about 0.01 to about 1.0 percent by weight of said transport layer in said layer of a halogen-containing organic solvent therein, and dispersed in said layer from about 25 to about 75 percent by weight based on said transport layer composition of a charge transport compound within the scope of the following structural formula:

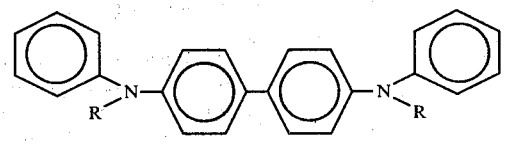

wherein R is

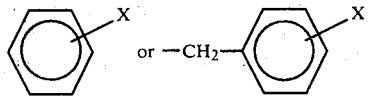

and wherein X is independently selected from the group consisting of an alkyl group having from 1 to about 4 carbon atoms and chlorine in the ortho, meta or para position, said charge transport layer being substantially nonabsorbing in the spectral region at which the photoconductive material generates and injects photogenerated holes but being capable of supporting the injection of photogenerated holes from said photoconductive material and transporting said holes through said charge transport layer, the improvement consisting of the inclusion in said transport layer of a stabilizing compound within the scope of the following structural formula:

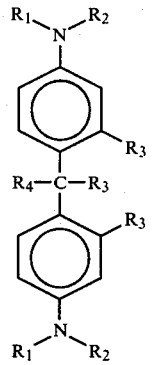

wherein $R_1$ and $R_2$ are independently selected from the group consisting of a $C_1$–$C_8$ alkyl, aryl, alkaryl and aralkyl, where said aryl is a phenyl group or a condensed ring group, where the alkyl group of said alkaryl and aralkyl is a $C_1$–$C_4$ group, $R_3$ is independently selected from the group consisting of hydrogen and $CH_3$; and $R_4$ is the same as $R_1$ and $R_2$ or a disubstituted aminophenyl group wherein the substituents are independently selected from the group consisting of a $C_1$–$C_8$ alkyl, aryl, alkaryl and aralkyl as defined supra, said stabilizing compound being present in an amount sufficient to at least minimize the deleterious effects of ultraviolet radiation.

2. The member of claim 1 wherein the weight ratio of said stabilizing compound to said charge transport compound is from 0.0005:1 to 0.1:1.

3. The member of claim 2 wherein said stabilizing compound is selected from the group consisting of bis(4′-N,N′-diethylamino-2-methylphenyl)phenyl methane; 1-bis-(4-dimethylaminophenyl)-1-phenyl ethane; and bis-[4-bis-(phenylmethyl)amino-2-chlorophenyl]-phenyl methane.

4. The member of claim 3 wherein said polycarbonate is poly(4,4′-isopropylidene-diphenylene carbonate) having a molecular weight of from 20,000 to about 120,000.

5. The member of claim 4 wherein said charge transport compound is N,N′-diphenyl-N,N′-bis(3-methylphenyl)-[1,1′-biphenyl]-4,4′-diamine.

* * * * *